United States Patent [19]

Pehrsson

[11] 4,036,163

[45] July 19, 1977

[54] APPARATUS FOR MOUNTING AND DISMOUNTING A SUBMERGED PROPELLER UNIT FOR A FLOATING BODY

[75] Inventor: Anders Lennart Pehrsson, Kristinehamn, Sweden

[73] Assignee: Aktiebolaget Karlstads Mekaniska Werkstad, Karlstad, Sweden

[21] Appl. No.: 691,838

[22] Filed: June 1, 1976

[30] Foreign Application Priority Data

June 6, 1975 Sweden ..... 7506470

[51] Int. Cl.[2] ..... B63H 5/12; B63H 5/14

[52] U.S. Cl. ..... 115/34 R; 114/151; 114/268; 114/269; 114/270; 115/35

[58] Field of Search ..... 115/35, 34 R, .5 R; 114/.5 D, 221 R, 151, 268, 269, 270; 416/244 B

[56] References Cited

U.S. PATENT DOCUMENTS

| | | | |
|---|---|---|---|
| 2,522,545 | 9/1950 | Sharp | 115/35 |
| 2,987,027 | 6/1961 | Wanzer | 114/.5 R X |
| 3,223,067 | 12/1965 | Horan | 115/35 |
| 3,377,978 | 4/1968 | Tillman | 115/35 |

*Primary Examiner*—Trygve M. Blix
*Assistant Examiner*—Gregory W. O'Connor
*Attorney, Agent, or Firm*—Brumbaugh, Graves, Donohue & Raymond

[57] ABSTRACT

Apparatus for mounting and dismounting a submerged propeller unit to and from the hull of a floating body from the outside thereof comprises a flange in the hull surrounding an opening therein and having passages therein, a flange on the propeller unit having fastening means corresponding to the passages in the hull flange, a drive coupling member on the propeller unit adapted to extend through the hull opening when the propeller unit flange is secured to the hull flange, guides on the propeller unit for guiding the coupling member into the hull opening and for positioning the propeller unit flange with its fastening threaded bores in registry with the passages in the hull flange as the propeller unit is raised to assembled position with its flange against the hull fange, a removable watertight chamber formed in the hull and communicating with the opening therein, cables extending through watertight ways in the hull and adapted to be secured detachably to the propeller unit to raise the same to bring the propeller unit flange to the level of the hull flange with the fastening threaded bores in the former in registry with the passages in the latter, and mechanism operable from outside said watertight chamber and extending therethrough for installing fastenings cooperating with said propeller unit flange fastenings and with said passages to secure said propeller unit flange to the hull flange.

7 Claims, 1 Drawing Figure

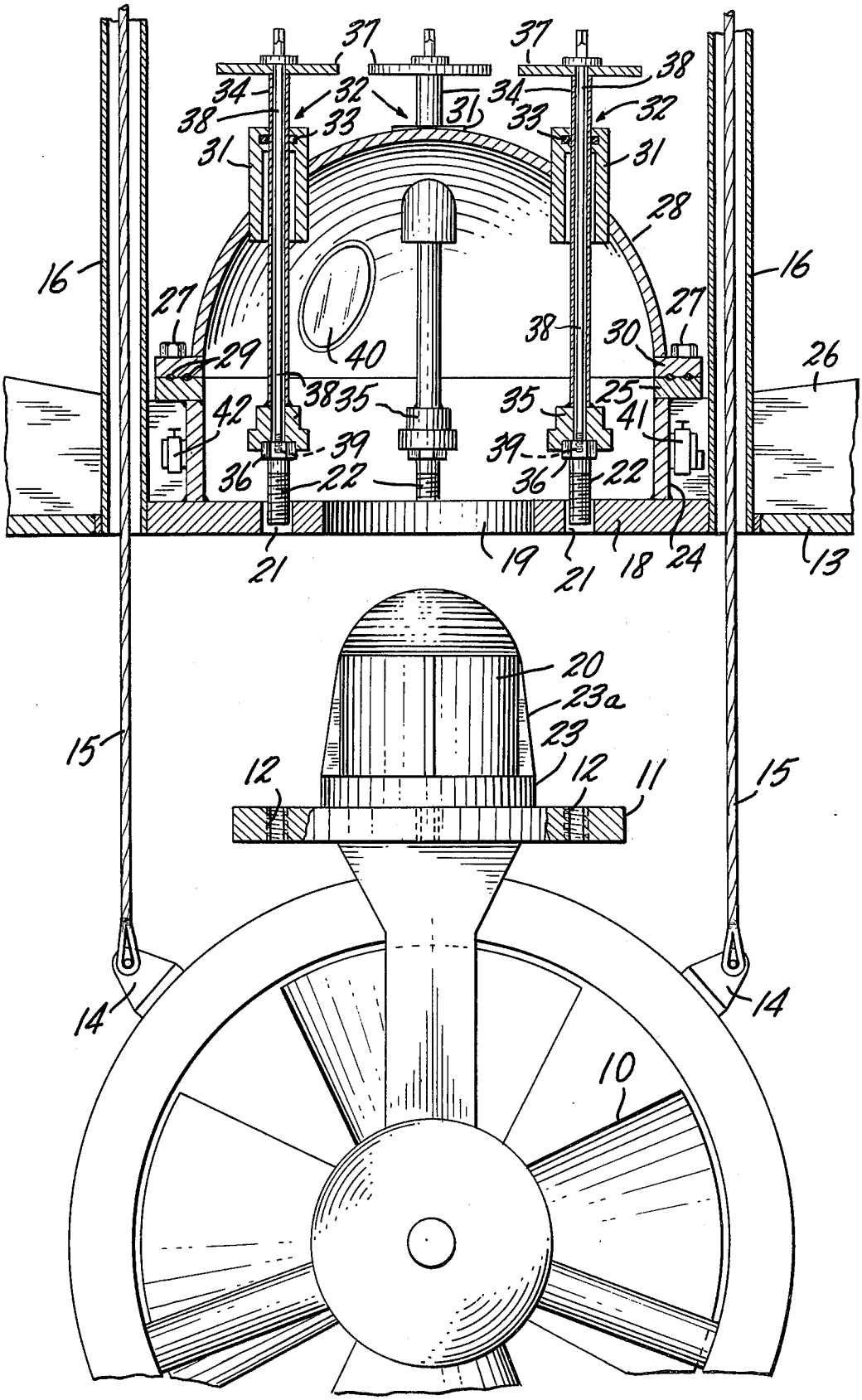
37
37
38
34
32
34
32
38
33
31
33
31
31
28
16
16
27
27
29
40
38
30
26
38
35
35
25
42
41
39
39
36
22
36
22
21
19
21
18
24
13
20
23a
23
15
12
12
11
15
14
14
10

APPARATUS FOR MOUNTING AND DISMOUNTING A SUBMERGED PROPELLER UNIT FOR A FLOATING BODY

BACKGROUND OF THE INVENTION

This invention relates to apparatus for mounting and dismounting a submerged propeller unit to and from the hull of a floating body from the outside thereof. More particularly, it relates to new and improved apparatus of this character which is of particular utility in connection with turnable steering propellers mounted on vertical driving shafts, so-called thrusters, which are used with deeply submerged floating bodies of the type that support oil drilling rigs.

Apparatus has been proposed heretofore for mounting and dismounting a propeller unit with a vertical drive shaft at the bottom of a vessel without docking the vessel. In one such arrangement (disclosed in Swedish Pat. No. 181,061), the work of mounting or dismounting the propeller unit takes place in a chamber or barrel in the vessel which has an open upper end located above the waterline of the vessel and a lower end secured in watertight relation to the bottom an opening therein. In practice, the propeller unit is lowered into position through the barrel and fastened by flanges forming a closure for the opening in the vessel bottom. Alternatively, the propeller unit may be raised into position from the outside of the vessel and thereafter secured to the hull by bolts inserted from inside the barrel.

Outside mounting has many advantages, especially for large vessels, since it eliminates the necessity for transporting the propeller unit within the vessel. The open barrel technique requires so much space, however, that it is not practical. In some cases, it is possible to pressurize the space in which the mounting or dismounting work is to be done so as to keep the water out of it. Working in a pressurized space, however, introduces further difficulties that make this technique unattractive.

SUMMARY OF THE INVENTION

The object of the present invention is to provide new and improved apparatus for mounting and dismounting a vertical shaft propeller unit to and from a floating body which is free from the above-noted defects of the prior art.

According to the invention, a removable, watertight housing is secured over the flanged opening in the hull in which the propeller unit is to be received, the propeller unit is positioned in the water outside the body and raised to bring a flange thereon in registry with the flange around the opening in the hull, and the two flanges are secured together in watertight relation by fastenings put in place by tools located within the watertight housing that are operable from a location outside the housing.

The propeller unit is adapted to be raised into position by cables detachably secured thereto which extend through watertight passages formed in the hull. Also, the propeller unit is provided with guide means adapted to cooperate with the flange surrounding the opening in the hull as the unit is raised into position to facilitate its entry into the opening and also to bring cooperating fastening means on the unit and on the hull into registry.

Pressure relief valve means may be provided for voiding water trapped under pressure within the watertight housing by the propeller unit as it is put in position, together with valve means for draining off water remaining in the vicinity of the propeller unit after it has been mounted securely in place.

The single FIGURE in the accompanying drawing is a view in vertical section through apparatus constructed according to the invention for mounting or dismounting a propeller unit to or from the hull of a floating body.

In the FIGURE, a vertical shaft propeller unit 10 is shown having a flange 11 in which are formed a plurality of threaded bores 12 to enable the unit to be mounted on the hull 13 of a floating body by fastening means such as bolts, for example. The unit 10 is provided with lifting means such as eyebolts 14, for example, to which cables 15 are adapted to be detachably secured to raise the unit to the mounting position. The cables 15 pass through watertight tubular guides 16 in the hull 13 to hoisting means such as a suitable crane (not shown) which may be located on a drilling rig supported by the floating body.

Formed in the hull 13 is a flange 18 surrounding an opening 19 in which the drive coupling 20 for the propeller unit 10 is adapted to be received. The flange 18 is provided with holes 21 in positional correspondence with the threaded bores 12 in the flange 11 to accommodate a plurality of bolts 22 for securing the flange 11 on the propeller unit 10 to the flange 18 in the hull 13.

Below the drive coupling 20 on the propeller unit 10 is a cylindrical portion 23, which is adapted to fit into the opening 19 in the hull. Also, the coupling 20 is provided with guiding edges 23a adapted to cooperate with the flange wall defining the opening 19 to guide the cylindrical portion 23 into the opening 19 and to facilitate positioning the threaded holes 12 in the flange 11 in registry with the holes in the flange 18.

The flange 18 has an upwardly extending ring like portion 24 secured to beams 26 fastened to the hull 13 for transmission of the propulsion forces and provided with a laterally extending flange 25 at its upper end. Detachably secured to the ring like portion 24 by means such as the bolts 27 is a flanged dome shaped member 28, conventional sealing means 29 being interposed between the flange 25 and the flange 30 to insure a watertight joint.

Mounted on the dome shaped member 28 at locations corresponding to the locations of the holes 21 in the flange 18 are a plurality of bushings 31 in which are journalled a plurality of tools 32 for retaining, tightening, and loosening the bolts used to secure the propeller unit flange 11 to the hull flange 18, suitable sealing means 33 being provided to insure watertightness.

Each of the tools 32 comprises a pipe 34 mounted in the bushing 31 for axial and turning movement therein, terminating at its lower end in a socket wrench 35 adapted to receive the head 36 of a bolt 22, and having a wheel or gear 37 at its upper end for turning the pipe 34.

Journalled in watertight fashion inside each pipe 34 is a rod 38 threaded at its lower end into a correspondingly threaded hole 39 in the center of the bolt head 36 to retain the same in the socket wrench 35. The upper end of each rod 38 is suitably shaped to enable it to be easily turned by means such as a torque wrench, for example.

The dome shaped member 28 is provided with an observation window 40 through which the progress of the mounting or dismounting operation can be monitored.

A pressure relief valve 41 is mounted in the ring like portion 24 for draining water from the space enclosed by the dome shaped member 28, the flange 18 and the ring like portion 24 to enable the flange 11 to be brought into close proximity to the flange 18. Also a drain cock 42 is mounted in the ring like portion 24 for draining water from the space enclosed by it and the dome shaped member 28 after mounting of the propeller unit 10 has been completed.

In a typical operation, the floating body is launched without a propeller unit and the opening 19 in the hull flange 18 is covered by a sealing plate (not shown) outside the hull 13 held in place by bolts extending through the bores 21 in the hull flange 18.

When the propeller unit is to be mounted in place, the dome shaped member 28 is placed over the cylindrical ring like member 24 and is tightly secured thereto by bolts 27 extending through the flanges 25 and 30. The tools 32 are moved until the heads 36 of the bolts 22 are snugly received in the socket wrenches 35 and the rods 38 are screwed into the threaded holes 39 in the bolts. The tools 32 are then turned to loosen the bolts 22 and the sealing plate is removed from the opening 19 by divers working in the water outside the floating body.

The cables 15 are then lowered and fastened to the lifting eyebolts 14 on the propeller unit 10 and the latter may be raised into mounting position by apparatus of the type disclosed in the copending application Ser. No. 691,840, filed June 1, 1976, by Kjell Haglund and Hakan Hasse Carlsson and in the copending application Ser. No. 691,778, filed June 1, 1976, by Kjell Haglund.

As the drive coupling 20 moves into the hull opening 19, the guide means **23*a* function to guide the cylindrical portion 23 into the opening 19 with the threaded holes 12 in the flange 11 in substantial registry with the holes 21 in the hull flange 18. If, during the raising of the unit, the pressure in the dome shaped member 28 increases above the value for which the relief valve 41** is set, the latter will open and therefore maintain the pressure below that value.

When the unit 10 has arrived at the fully raised position, the tools 32 are lowered to insert the bolts 22 in the holes 21 in the flange 18 and are then rotated to screw the bolts 22 into the threaded holes 12 in the flange 11. When the bolts 22 have thus been tightened down, the rods 38 are unscrewed from the bolts 22 and the socket wrenches 35 are raised out of the way. The water in the space inside the dome shaped member 28 is then drained by opening the drain cock 42, and the dome shaped member 28 is removed by unscrewing the bolts 27. The drive coupling 24 may then be connected to motive means in the floating body in the known manner.

In dismantling the propeller unit 10 from the floating body, the cables 15 are first secured to the lifting eyebolts 14 to prevent the unit from dropping when the bolts are removed, and the detachable dome shaped member 28 and the tools 32 are used essentially as described above to remove the bolts 22 holding the propeller unit 10 to the hull flange 18. If necessary, the opening 19 may then be covered by a sealing plate put in place as previously described.

The illustrative embodiment of the invention described herein and shown in the drawing is obviously susceptible of modification in form and detail within the scope of the appended claims. For example, the pressure relief valve 41 may be located in the dome shaped member 28 instead of the cylindrical portion 24. Other modifications will be readily apparent to those skilled in the art.

I claim:

1. Apparatus for mounting and dismounting a submerged propeller unit having a flange adapted to be secured by fastening means on the outside of a flange surrounding an opening formed in an outside wall of a floating body below the waterline, wherein the improvement comprises a watertight enclosure detachably secured inside said body and covering said wall flange and opening, a plurality of means in the wall of said enclosure providing access to the interior thereof from inside the body, and a plurality of tool means extending through said respective access means in watertight relation thereto and operable from a location inside the body and outside the enclosure for adjusting a plurality of fastening means inside the enclosure to render the same effective or ineffective to secure a propeller unit flange on the outside of said body opening flange.

2. Apparatus as defined in claim 1 wherein each of the tool means comprises a tubular member mounted for axial and turning motion in one of said access means in said enclosure and in watertight relation thereto, means forming a socket wrench at the lower end of the tubular member, means mounted at the upper end of the member for imparting a turning movement thereto, and means for retaining fastening means releasably at said socket wrench.

3. Apparatus as defined in claim 2 wherein the retaining means comprises a rod extending through said tubular member in watertight relation thereto, said rod having a threaded lower portion adapted to fit in a threaded hole in the top of a bolt, and an upper portion turnable from outside the watertight enclosure.

4. Apparatus as defined in claim 1 wherein the watertight enclosure is formed by a dome shaped member having flange means adapted to be detachably secured to cooperating flange means at the upper end of a cylindrical member secured to the hull of the floating body around the opening therein.

5. Apparatus as defined in claim 1 having a pressure relief valve for limiting the buildup of pressure in said watertight enclosure.

6. Apparatus as defined in claim 1 having valve means for draining fluid from said watertight enclosure.

7. Apparatus as defined in claim 1 having observation window means in said watertight enclosure enabling the monitoring of operations being conducted therein.

* * * * *